United States Patent [19]

Killermann

[11] 4,312,173

[45] Jan. 26, 1982

[54] APPARATUS FOR BUNDLING RODS, TUBES, SECTIONS, ETC.

[75] Inventor: Richard Killermann, Röthenbach, Fed. Rep. of Germany

[73] Assignee: Kabelmetal Messingwerke GmbH, Nuremberg, Fed. Rep. of Germany

[21] Appl. No.: 914,387

[22] Filed: Jun. 12, 1978

[30] Foreign Application Priority Data

Jun. 10, 1977 [DE] Fed. Rep. of Germany ..... 2726305

[51] Int. Cl.[3] ..... B65B 27/10

[52] U.S. Cl. ..... 53/556; 53/585

[58] Field of Search ..... 100/9; 53/399, 491, 53/556, 585

[56] References Cited

U.S. PATENT DOCUMENTS

| | | | |
|---|---|---|---|
| 203,867 | 5/1878 | Abbott | 53/585 X |
| 679,732 | 8/1901 | Dederick | 100/9 |
| 1,508,258 | 9/1934 | Sikma | 100/9 |
| 1,955,949 | 4/1934 | Corton | 53/441 X |
| 3,135,076 | 6/1964 | Hill | 53/399 |
| 3,264,796 | 8/1966 | Tomczak | 53/585 X |
| 3,393,633 | 7/1968 | Hoffman et al. | 53/441 X |
| 3,792,564 | 2/1974 | Brady, Jr. | 53/585 X |

FOREIGN PATENT DOCUMENTS

| | | | |
|---|---|---|---|
| 119916 | 9/1899 | Fed. Rep. of Germany | 100/9 |
| 659074 | 6/1929 | France | 100/9 |

*Primary Examiner*—John Sipos

*Attorney, Agent, or Firm*—Smyth, Pavitt, Siegemund & Martella

[57] ABSTRACT

A bundling device for rods having a hollow mandrel through which the rods are passed and which mandrel has prongs that are provided with steps. The steps carry elastic rings which are removed from the prongs onto the rods by a stripper. The stripper consists of a tubular member that surrounds the prongs and which has protrusions for engaging the rings and stepwise moving the rings along and off the steps of the mandrel as relative movement is created between the stripper and the prongs.

3 Claims, 7 Drawing Figures

APPARATUS FOR BUNDLING RODS, TUBES, SECTIONS, ETC.

BACKGROUND OF THE INVENTION

The present invention relates to a method and a device for bundling bars, tubes, sections, etc.

Pressed and, possibly subsequently bright drawn sections are usually cut to length, packed in handy bundles and transported to the user. It is essential for this transportation that each section is kept in the bundle without shifting in longitudinal direction. This is particularly required particularly if bright drawn sections are to be shipped, because if permitted to shift their surface will experience undesired damages. Also elongated stock made of a metal tending to cold weld, the pieces of stock will, indeed, cold weld together.

In order to solve these problems, one has placed adhesive strip with a paper substrate onto and around the bundles, and in several spaced-apart loops. Another practice provided for placing holding strips made of plastic, and wrapping them around the bundle in particular axial distance from each other. Both solutions have in common that they either incur high labor cost or require expensive machines, and they cannot readily and economically be integrated in a continuous production process. Moreover, the relatively thin adhesive strips or plastic strips are relatively susceptible to damages.

DESCRIPTION OF THE INVENTION

It is an object of the invention to provide a method for economically bundling, rods, tubes, sections, etc., in a continuous process and in such a manner so that each rod, each tube, or each section is held in the bundle without shifting in longitudinally axial direction, and the means holding the bundle together are to be substantially insensitive to mechanical damage but still can be cut open easily by the user of the rods, by means of suitable tools.

The object is accomplished in that at least two rings made of a spring elastic material are spread-apart on a mandrel, that the pre-bundled rods, tubes, sections, etc., are guided through the openings of the rings or the spread rings are moved longitudinally axially for surrounding the pre-bundled rods, tubes, sections, etc., and that in predetermined distances, respectively, one ring at a time is drawn from the mandrel, and thereby clamped around the bundle. This method may use rings of a rubber elastic material with particular advantage. The said material is characterized by a high extension and for this reason can be spread without damage. One should use rings having a cross-section with a flattened wall in the direction of the longitudinal axes. This feature has the advantage that the rings which constitute a one way packing, are relatively inexpensively available in the market. Another advantage is to be seen in that the rings sit on the bundle relatively immobile. In order to facilitate stripping the rings off the mandrel, it was found advantageous to coat the rings with a lubricant, such as, for example, talcum powder, placed in the inner surface area of the ring alternatively, rings having round wall cross-section can be used with advantage. These rings can readily be stripped off a mandrel without further auxiliary means, and they offer the further advantage that they roll in longitudinal-axial direction upon exertion of force upon the surface of the bundle, thereby preventing mechanical damage to the rings. In order to distribute the force as exerted by the pretensioned rings, as uniform as possible over the length of the bundle, it was found suitable to clamp the rings upon the bundle in similar axial distances to each other. If the rings on the spread mandrel are stripped off by a device surrounding the mandrel, it was found suitable to respectively strip one ring off the mandrel by shifting the mandrel and/or the stripping device relative to each other. This mode of operation makes possible placing the rings upon the bundle almost without any damage. Since it is suitable to store several rings on the mandrel, it is of advantage to shift all rings on the mandrel during stripping by one stripping step by the same distance and in the same direction as the ring to be stripped off entirely and on to the bundle. Just one ring will thereby slide off the mandrel, while the others are shifted one position down.

For carrying out the method according to the teaching of the invention, a device was found suitable in which two ring disks arranged coaxially to each other are provided with a central bore for passing through of the bundle. The disks are interconnected by at least three screws, guarded respectively in three longitudinal slots in one of the disks, being rotatably mounted. At least three segments are spaced equidistantly in relation to the bore and in-between the disks. The segments are movable in the direction of the longitudinal slots upon turning of the rotatable ring disk and by means of pins guided in the slots which extend at an angle to a radial line. Each segment is provided with a prong extending in axial direction and having a length which corresponds at least to the sum total of the width of all the rings. Furthermore, a stripping device is provided to concentrically surround the prongs. The ring disks and/or the stripping device are displaceable in axial direction in relation to each other. It was found particularly advantageous in such a device that the stripping device be kept in a stationary position and the ring disks are axially drivable by a hydraulic cylinder. The rotatable ring disk should also be drivable by a hydraulic cylinder. The stripping device is appropriately made of a piece of tubing into whose inner wall stripping rings have been worked of different inner diameter, which increase in the direction towards the ring disks.

This version permits for corresponding stroke adjustment that but one ring is stripped off while the other rings are moved in the same direction and for the same distance. In order to simplify this procedure, the prongs are provided with steps at its outer surface corresponding to the stripping rings, for receiving the rings.

DESCRIPTION OF THE DRAWINGS

The invention is explained in greater detail with reference to the examples illustrated schematically in FIGS. 1 through 8.

Figures 1, 2, 3, 4:
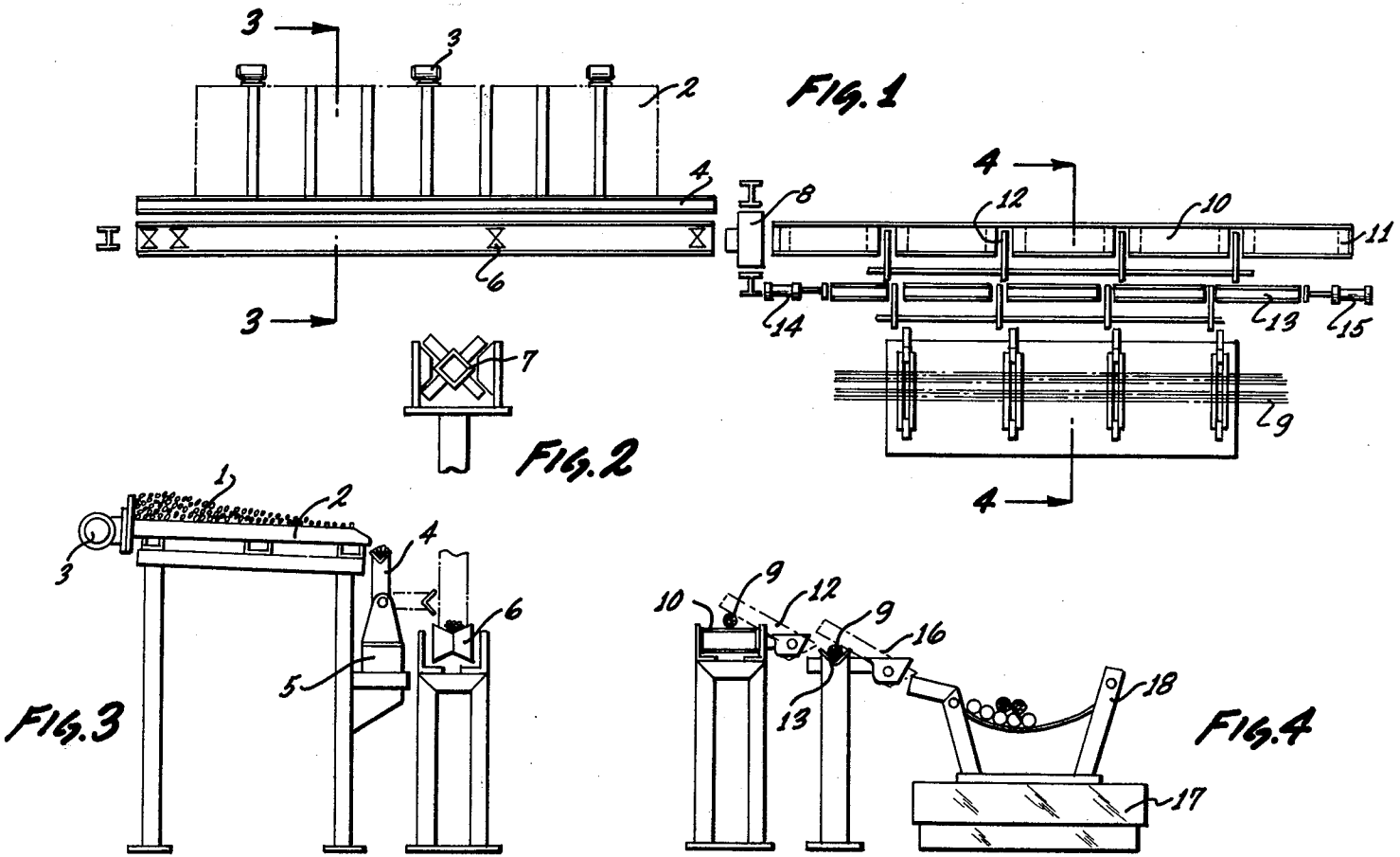
FIG. 1 illustrates a top elevation of an installation for packing tubes, rods, or sections.
FIG. 2 illustrates a bundle shifter transporting the pre-bundles.
FIG. 3 illustrates a section along line A–B.
FIG. 4 illustrates a section along line C–P.
Figure 6:
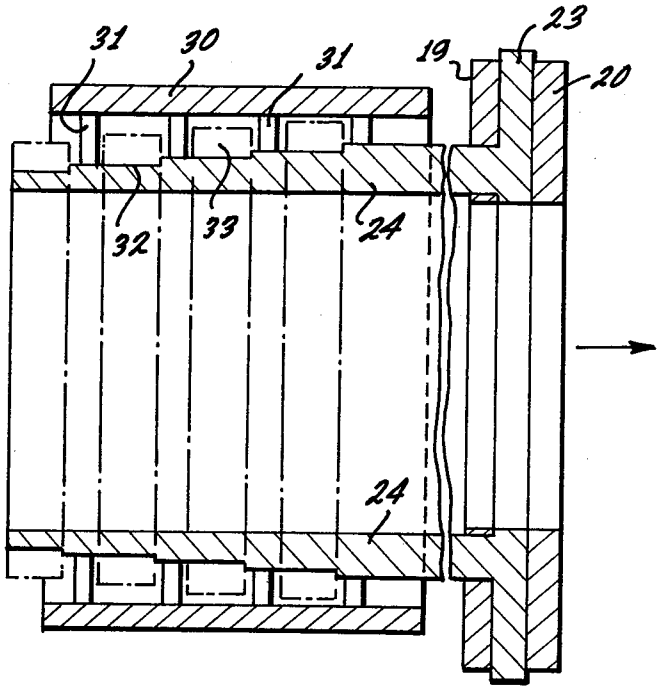
FIGS. 5 and 6 illustrate an enlarged view of the device for placement of the rings.
Figure 5:
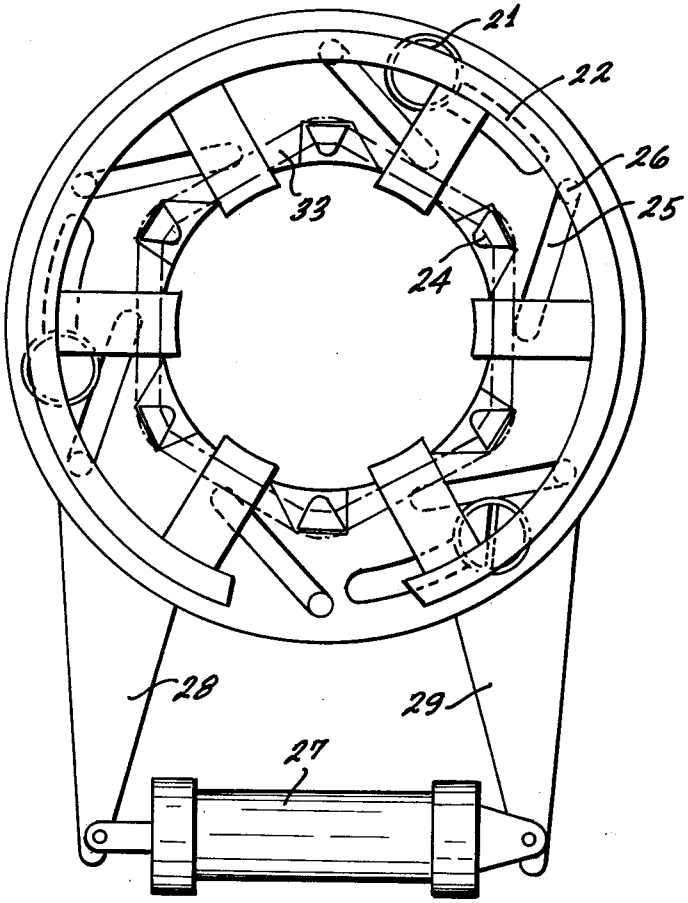

Tubes 1 as shown in FIG. 1 have been made on a drawing or straightening machine, not shown, and are laid onto a vibrating table 2 by means of a crane, which is also not shown. The vibrating table 2 separates the tubes by means of vibrators 3, so that the tubes drop into a tilting chute 4, which is mounted on a scale 5. The vibrating table 2 will be turned off by means of an adjustable weight responsive contact. The tilting chute 4 places the tube 1 to be bundled upon a V-shaped roller track 6. The tubes are shifted by a driven bundle shifter 7 through a prong-like bundling device 8, described in greater detail below, which places rubber rings in particular longitudinally, axially spacing onto the bundled tubes 1. The bundle 9 is transported on a sectionalized conveyor belt 10 being disposed downstream from the bundling device 8 until abutting against a stop 11. The bundle 9 is layed into a V-trough 13 by means of ejectors 12, and straightened from the front by means of cylinders 14 and 15. Another ejector 16 lifts the bundle 9 onto a collector stake (stanchion) 18 or a box installed on a scale 17.

The bundling device is essentially comprised of two ring disks 19 and 20, which are guided on each other by means of screws 21. The ring disk 19 is stationarily mounted but, ring disk 20 is rotatably mounted. During such rotation the shanks of the screws are guided in longitudinal slots 22. Several segments 23 are disposed between the two ring disks 19 and 20, each segment carrier a prong 24. These prongs together establish the mandrel. Longitudinal slots 25 are provided in the ring disk 20, extending at an angle to a radius, into which slot pins 26 each being connected to each segment 23, so that upon rotation of ring disk 20, the segments move uniformly in the direction of the longitudinal slots 25. The rotation of the ring disks 20 is caused by a hydraulic cylinder 27 which is connected to the ring disk 19 by means of an arm 28 and to the ring disk 20 by means of an arm 29. Thus, upon actuation of the hydraulic cylinder 27, the distance between the individual segments is changed and the distance between the individual prongs is changed accordingly. The prongs 24 are surrounded by a piece of tubing 30. Stripper rings 31 have been worked into the inner wall of tube 30. The step height of the rings differ and decrease in the direction towards ring disk 19. Corresponding steps 32 are worked into the prongs 24. During operation, a plurality of rubber rings 33 are placed onto the prongs 24, one per step and in a number as required for holding the tubes 1 in a bundle 9. As a bundle 9 passes through the interior space of the bundling device 8, the device 8 is moved by a hydraulic cylinder, not shown, in opposition to the direction of movement of the bundle and by a distance which corresponds at least to the extension of the rings in the direction of passage of the bundle 9. Thereupon, the ring 33 on the last step 32 of prongs 24 is stripped off and clamps itself onto the bundle 9, the other rings 33 are shifted one step down each. The movement of the bundling device by one stroke distance, is triggered when the bundle pushes (FIG. 2) end position switches, not shown. After all of the rings 33 have been placed around the respective bundle 9, the bundling device is returned to its initial money pounding position. The prongs approach each other radially and new rings 33 are placed thereon.

The rings 33, which are found to have a rectangular cross-section of their walls, but may be circular instead, carry a thin talcum layer on the inner wall engaging the prongs 24 in order to facilitate the stripping off action.

Figure 8:
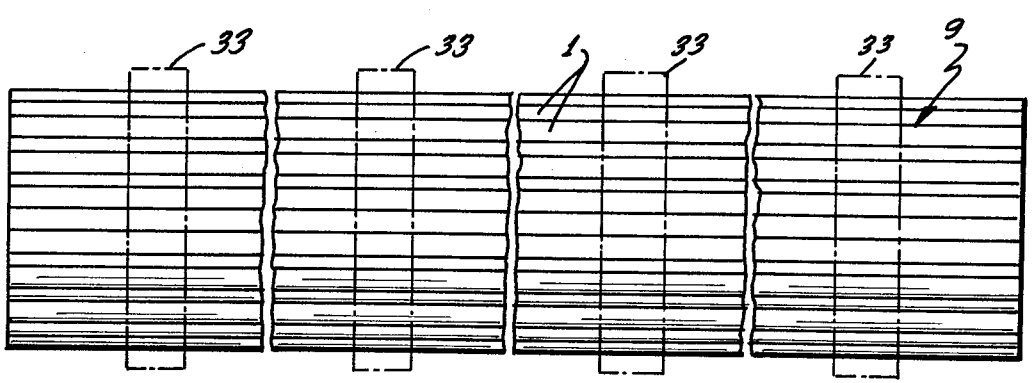
FIGS. 7 and 8 each illustrate a view of completed bundles.
Figure 7:
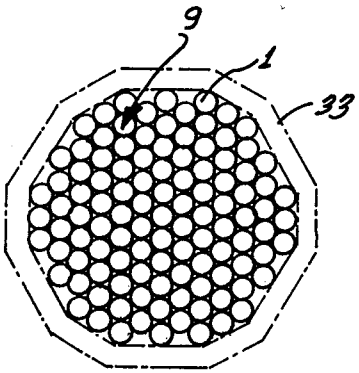

The FIGS. 7 and 8 illustrate a completed bundle 9 with rubber rings 33 thereon.

The method in accordance with the teaching of the invention operates almost completely automatical and only one man is required for operating the device. The device can be made at low cost and is almost completely free from maintenance. Another essential advantage of the inventive method is that bundles can be assembled at a rate of about 15 seconds.

I claim:

1. Apparatus for bundling rods, tubes, sections, or the like, comprising:

means for assembling the rods, tubes, or sections into a pile-like bundle;

a hollow mandrel including axially extending prongs being provided with steps and mounted for radial movement and displacement relative to each other, the steps carrying expanded elastic rings;

means for providing the radial displacement of said prongs;

means for passing the bundle through the mandrel; and a tubular member disposed for movement relative to the mandrel and having protrusions for engaging the rings and stepwise moving the rings along and off the steps of the mandrel to be seated onto the bundle as passing through.

2. Apparatus for bundling elongated stock such as rods, tubes, sections, or the like, comprising:

means for assembling the stock into a pile like bundle;

a plurality of prongs mounted around an axis and for radial displacement, the prongs having steps for holding expanded rings; and a tubular stripper concentrically surrounding the prongs and having steps to move the rings in steps down on the steps of the prongs and one by one off the prongs;

means for passing the bundle coaxially through the prongs so that the rings are clampingly seated one by one onto and around the bundle as stripped off by the stripper.

3. Apparatus as in claim 2, said prongs being mounted on segments having pins, an annular disk with oblong slots extending at an angle to a radius for guiding the pins to thereby move the segments and the prongs radially; and means for mounting the disk for rotation.

* * * * *